US011131037B2

(12) United States Patent
Hirschmann et al.

(10) Patent No.: US 11,131,037 B2
(45) **Date of Patent: *Sep. 28, 2021**

(54) ALUMINIUM ALLOY SHEET OPTIMISED FOR FORMING

(71) Applicants: Frank Hirschmann, Nettetal (DE); Kathrin Eckhard, Alfter (DE); Bernhard Kernig, Cologne (DE); Gernot Nitzsche, Meckenheim (DE); Henk-Jan Brinkman, Bonn (DE)

(72) Inventors: Frank Hirschmann, Nettetal (DE); Kathrin Eckhard, Alfter (DE); Bernhard Kernig, Cologne (DE); Gernot Nitzsche, Meckenheim (DE); Henk-Jan Brinkman, Bonn (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/046,458

(22) Filed: Jul. 26, 2018

(65) Prior Publication Data

US 2018/0340268 A1 Nov. 29, 2018

Related U.S. Application Data

(63) Continuation of application No. PCT/EP2017/051519, filed on Jan. 25, 2017.

(30) Foreign Application Priority Data

Jan. 27, 2016 (EP) ..... 16152889

(51) Int. Cl.
*C25F 3/04* (2006.01)
*B21D 22/20* (2006.01)
(Continued)

(52) U.S. Cl.
CPC ..... *C25F 3/04* (2013.01); *B21D 22/201* (2013.01); *C23C 22/78* (2013.01); *B21D 53/88* (2013.01); *C22F 1/04* (2013.01)

(58) Field of Classification Search
CPC ..... B21D 22/201; B21D 53/88; C22F 1/04; C23C 22/78; C25F 3/04
(Continued)

(56) References Cited

U.S. PATENT DOCUMENTS 6,165,630 A 12/2000 Gehlhaar et al.
9,321,090 B2 * 4/2016 Xia ..... B21D 22/00
(Continued)

FOREIGN PATENT DOCUMENTS

CN 103228457 A 7/2013
CN 108633289 A 10/2018
(Continued)

OTHER PUBLICATIONS

NPL: English abstractor JP07011402A, Jan. 1995 (Year: 1995).*

*Primary Examiner* — Jie Yang
(74) *Attorney, Agent, or Firm* — Reinhart Boemer Van Deuren P.C.

(57) ABSTRACT

The invention relates to a strip or sheet consisting of an aluminium alloy having a unilateral or bilateral surface structure prepared for a forming process, in particular it relates to a strip or sheet for formed motor vehicle components. The object of providing an aluminium alloy strip or sheet having a surface structure prepared for a forming process, which is easy to produce and has improved tribological characteristics in respect of a subsequent forming process, is achieved for a strip or sheet consisting of an aluminium alloy in that the strip or sheet has on one side or
(Continued)

on both sides a surface with depressions as lubricant pockets which are produced using an electrochemical graining process.

20 Claims, 7 Drawing Sheets

(51) Int. Cl.
*C23C 22/78* (2006.01)
*B21D 53/88* (2006.01)
*C22F 1/04* (2006.01)

(58) Field of Classification Search
USPC ..... 148/526
See application file for complete search history.

(56) References Cited

U.S. PATENT DOCUMENTS

| | | | | |
|---|---|---|---|---|
| 10,889,912 | B2 * | 1/2021 | Kernig | C22C 21/00 |
| 2002/0029709 | A1 * | 3/2002 | Sawada | B41N 1/083 101/453 |
| 2008/0102404 | A1 | 5/2008 | Tashiro et al. | |
| 2013/0263749 | A1 * | 10/2013 | Kernig | B41N 1/083 101/368 |
| 2013/0291613 | A1 * | 11/2013 | Xia | B21D 22/00 72/350 |
| 2018/0347067 | A1 * | 12/2018 | Kernig | C25F 7/00 |

FOREIGN PATENT DOCUMENTS

| | | | | | |
|---|---|---|---|---|---|
| DE | 10345934 | A1 | | 5/2004 | |
| DE | 60213567 | T2 | | 12/2006 | |
| JP | S63141722 | A | | 6/1988 | |
| JP | S63-188428 | A | | 8/1988 | |
| JP | 2-58295 | A | | 2/1990 | |
| JP | H06287722 | A | | 10/1994 | |
| JP | 07011402 | A | * | 1/1995 | C22C 21/06 |
| JP | 9-304938 | A | | 11/1997 | |
| JP | 2002210865 | A | | 7/2002 | |
| JP | 2004-323913 | A | | 11/2004 | |
| JP | 2005-502781 | A | | 1/2005 | |
| JP | 2008-111142 | A | | 5/2008 | |
| JP | 2015-53240 | A | | 3/2015 | |

* cited by examiner

ALUMINIUM ALLOY SHEET OPTIMISED FOR FORMING

CROSS-REFERENCE TO RELATED PATENT APPLICATIONS

This patent application is a continuation of PCT/EP2017/051519, filed Jan. 25, 2017, which claims priority to European Application No. 16152889.8, filed Jan. 27, 2016, the entire teachings and disclosure of which are incorporated herein by reference thereto.

FIELD OF THE INVENTION

The invention relates to a strip or sheet consisting of an aluminium alloy having a unilateral or bilateral surface structure which is provided at least in some regions and is prepared for a forming process, in particular it relates to a strip or sheet for formed motor vehicle components. The invention also relates to a method for producing a strip or sheet having a unilateral or bilateral surface structure prepared for a forming process consisting of an aluminium alloy, and to a corresponding use of a formed strip or sheet.

BACKGROUND OF THE INVENTION

In the automobile industry, sheets of aluminium alloys are increasingly being used to realise weight reduction potentials in automotive engineering. Strips and sheets for the production of motor vehicle components are usually produced from aluminium alloys of type AA7xxx, AA6xxx, AA5xxx or AA3xxx. They are characterized by medium to very high strengths and by a very good forming behaviour. The strengths are essentially material characteristics, whereas the formability is influenced, inter alia, by a combination of the material characteristics, surface topography, the amount of lubricant, the type of lubricant and the tool surface. Here, the material itself with its forming properties, for example the elongation at break, is paramount. In addition, however, the surface topography or the surface structure of the strip or sheet also matters significantly as does the amount of lubricant on the surface of the sheet. At the same time, the tool material, the tool surface, the contact pressure during forming, the temperature and the forming rate have a significant impact. To provide maximum forming properties already during production of the strip or sheet, strips and sheets of an aluminium alloy are usually provided with a surface structure in the last rolling pass in order to introduce recesses into the strip or sheet surface on one or both sides which act as lubricant pockets. By means of these lubricant pockets, an applied lubricant remains on the sheet surface up until the forming process allowing higher forming degrees of the sheet or strip. During forming, the lubricant can also be transported out of the lubricant pockets to other regions of the sheet, to ensure therein a local adequate lubrication. For this purpose, the rolls which are used are provided with a texture which, depending on the chosen method for structuring the roll, results in a different texture on the strip. Thus, for example, a surface structure produced by an "electrical discharge texturing" (EDT) method provides a high number of peaks in the surface profile. By means of an "electron beam texturing" (EBT) method, depressions in the surface distributed in a controlled manner can be provided. By a "shot blasting texturing" (SBT) method, the embossing rolls can also be textured. Also, a structured layer of chromium or laser-textured surfaces have been used. Common to all production steps is the fact that the surface structure is transferred from the roll to the surface of the aluminium strip by means of a roll-embossing step. Typically, in doing so, the thickness of the strip is reduced again in order to be able to transfer the texture.

High demands are imposed on the forming properties in other technical fields as well, for example in the production of beverage cans, in particular of the body and the top of the can, consisting of AA3xxx or AA5xxx aluminium alloys.

The German translation of the European patent DE 602 13 567 T2 discloses a method for embossing a surface structure of aluminium strips, in which the texture is embossed by a plurality of passes without reduction of the thickness of the strip. In addition, it is stated that, for the use of lithographic printing plate supports, a suitably roll-embossed sheet can also be subjected to an electrochemical graining process. However, lithographic printing plate supports are neither suitable for motor vehicles nor are they intended for further forming steps. This is rather a completely different field of application of aluminium sheets, as the sheets are roughened electrochemically in order to be provided with a coating and to be used for printing. In any case, with regard to improvement of the forming behaviour of aluminium alloy strips or sheets in forming processes, the mentioned European patent does not contain any information for a person skilled in the art.

The US patent application US 2008/0102404 A1 discloses an electrochemical graining of an aluminium surface for the production of lithographic printing plate supports for roughening the surfaces. Unlike electrochemical pickling which uses direct current, electrochemical graining is carried out using alternating current or pulsed direct current. As a result, the pickling process is repeatedly interrupted and the surface is not deeply etched, for example deep channels are not etched, but only superficial wells are produced, i.e. the surface is grained or roughened. Lithographic printing plate supports, however, are not intended for further forming.

The Japanese patent application JP S63 141722 discloses a method for producing a rolled aluminium sheet for forming processes into which deep microchannels are etched by electrolytic pickling, which serve to anchor a polyamide layer on the sheet. The forming of the sheet is said to be facilitated by the polyamide layer. However, the present invention is not concerned with the provision of sheets and strips having a polyamide coating. Rather, strips and sheets are to be provided which are used in a motor vehicle, for example, and are lacquered after forming. Therefore, an improvement in the forming properties of the strips or sheets is to be achieved without a coating of polyamide.

The Japanese patent application JP H06 287722 describes a method for coating an aluminium strip with fluoroplastics, the surface of the strip also being initially etched electrolytically using direct current.

The German published patent application DE 103 45 934 discloses an aluminium strip for motor vehicle components which is prepared for forming, the surface being conventionally roll-embossed, for example using EDT-textured rolls.

BRIEF SUMMARY OF THE INVENTION

Starting from this, the object of the present invention is to provide an aluminium alloy strip or sheet having a surface structure prepared for a forming process, which can be easily produced and has improved tribological characteristics in respect of a subsequent forming process. A further object of the invention is to suggest a method for producing a corresponding aluminium alloy strip or sheet, and the use thereof.

According to a first teaching of the present invention, the object is achieved for a strip or sheet of an aluminium alloy in that the strip or sheet has, on one side or on both sides, a surface with depressions as lubricant pockets which are produced using an electrochemical graining method.

The inventors have found that, using an electrochemical graining method, it is possible to introduce into the surface of an aluminium alloy strip or sheet lubricant pockets which can significantly improve the forming behaviour of the sheet, i.e. which influence the tribological characteristics of the sheet in a significantly positive way. This is of particular interest in the case of sheets which have a minimum thickness of 0.8 mm, since for sheets or strips of these thicknesses, in addition to the material characteristics, particularly also the surface characteristics become more significant during forming due to the higher forming forces compared to thinner sheets or strips. Compared to conventional, mechanically embossed surface structures, it has been found that electrochemically grained surfaces have a significantly different structure. The surface of the aluminium alloy strip furthermore has the rolled-in, plateau-like texture which is interpersed by depressions introduced into the surface by electrochemical graining. This is clearly different from the rolled-in surface textures or depressions used hitherto. The depressions introduced into the aluminium alloy strips or sheets during electrochemical graining have a higher enclosed volume and thus a significantly greater reduced well depth compared to the mechanical embossing methods. In addition to the surface structure previously introduced by rolling, for example a "mill finish" surface structure, the surface has depressions partially falling away very abruptly from the surface and partially having undercuts or negative aperture angles. This configuration of the depressions is specifically attributed to the production method by electrochemical graining. Due to the specific shape of the depressions caused by electrochemical graining, the aluminium alloy strip or sheet according to the invention has an improved receiving behaviour toward lubricants used for forming. The depressions which are formed as lubricant pockets and have been introduced into the sheet by electrochemical graining exhibit a significantly greater reduced well depth and a significantly higher closed empty volume. In this respect, a greater amount of lubricant can be provided for the forming process. This is also reflected in the improved forming properties of the strips or sheets produced in this manner. Furthermore, electrochemical graining is a method which can be used on a large economical scale and is thus suitable for mass production.

The strip or sheet of an aluminium alloy preferably has a minimum thickness of 0.8 mm. Aluminium alloy strips or sheets having a thickness of at least 0.8 mm are often subjected to a forming process, for example to deep-drawing, in order to bring a planar sheet into a specific form required for use, for example. Preferred thicknesses in the automotive sector are also 1.0 to 1.5 mm or up to 2.0 mm. However, aluminium sheets having thicknesses of up to 3 mm or up to 4 mm are also formed in forming processes, and are used in the automotive sector, for example in chassis applications or as structural parts. The greater the thicknesses, the higher the forming forces which are required. However, the demands imposed on the forming properties of the sheets, on the surface thereof and on the materials increase therewith. The surface finish according to the invention thus plays a part in contributing to achieving improved forming results in all thickness ranges, but particularly in the higher thickness ranges above 0.8 mm.

According to a further embodiment, the strip or sheet at least partially consists of an aluminium alloy of type AA7xxx, type AA6xxx, type AA5xxx or of type AA3xxx, in particular of an aluminium alloy of type AA7020, AA7021, AA7108, AA6111, AA6060, AA6016, AA6014, AA6005C, AA6451, AA5454, AA5754, AA5251, AA5182, AA3103 or AA3104. In addition, an AlMg6 alloy can preferably also be used for the strip or sheet. Finally, the use of plated composite materials with the above-mentioned alloys, for example as a core alloy, is also conceivable. For example, a core alloy of type AA6016 or AA6060 plated with an AA8079 aluminium alloy already has very good forming properties without the surface treatment by electrochemical graining. It is assumed that these properties can be additionally improved by the surface texture according to the invention. Common to the mentioned aluminium alloys is the fact that they are usually preferred for use in motor vehicles. They are distinguished by a high formability and by providing medium to very high strengths. For example, by hardening after forming, aluminium alloys of type AA6xxx or AA7xxx can achieve very high strengths and are used in structural applications. The mentioned aluminium alloys of type AA5xxx and AlMg6 with high contents of magnesium cannot be hardened, but they have high strength values right away in addition to a very good forming behaviour. Alloys of type AA3xxx provide medium strengths in automotive engineering and are preferably used for components for which strength is paramount and a high formability is required. It has been found that in the case of the above-mentioned materials, a particular increase in the forming behaviour of strips and sheets according to the invention can be achieved.

AA3xxx alloys, for example the AA3104 or AA3103, and some AA5xxx, such as the mentioned AA5182 but also the alloys AA5027 or AA5042, are also used for producing beverage cans and therefore must also have very good forming properties while at the same time having good surface characteristics after forming. It is therefore assumed that the aluminium alloys of type AA3xxx and AA5xxx, in particular the mentioned AA3104, AA3103, AA5182, AA5027 or AA5042, also benefit from the specific, electrochemically grained surface during forming procedures with high degrees of forming in beverage can production.

As already mentioned, the electrochemical graining method results in a very specific surface topography, i.e. in specifically shaped depressions, which act as lubricant pockets. According to EN ISO 25178 on areal roughness measurement, the reduced peak height $S_pk$, the core roughness depth $S_k$ and the reduced well depth (also called reduced groove depth) $S_{vk}$ are provided to describe the specifically formed surface topography.

All three mentioned parameters can be read from a so-called Abbott curve according to EN ISO 25178. To obtain the Abbott curve, a surface is usually measured optically in three dimensions. Planar areas, extending parallel to the measured surface, are introduced into the measured three-dimensional height profile of the surface in a height c, where c is preferably determined as the distance to the zero position of the measured surface. The surface area of the intersecting area of the introduced planar areas with the measured surface in height c is calculated and divided by the total measurement area in order to obtain the area portion of the intersecting area of the total measurement area. This area portion is determined for different heights c. The height of the intersecting area is then presented as a function of the area portion, from which the Abbott curve is derived, FIG. 1.

The reduced peak height ($S_{pk}$), the core roughness depth ($S_k$) and the reduced well depth ($S_{vk}$) can be determined by means of the Abbott curve. All three parameters refer to different surface characteristics. It has been found that in particular the reduced well depth ($S_{vk}$) correlates with an improved forming behaviour.

The Abbott curve usually has an S-shaped course for rolled surfaces. In this S-shaped course of the Abbott curve, a secant with a length of 40% of the material portion is displaced in the Abbott curve until it has a minimum increase amount. This is usually the case in the inflection point of the Abbott curve. The extension of this straight line up to 0% or 100% material portion in turn results in two values for the height c at 0% and 100% material portion, respectively. The vertical distance of the two points reveals the core roughness depth $S_k$ of the profile. The reduced well depth $S_{vk}$ results from a triangle $A_2$, coextensive with the valley surfaces of the Abbott curve, with a base length of 100%−Smr2, where Smr2 results from the intersection point of the Abbott curve with a parallel to the X-axis, which runs through the intersection point of the extension of the secant with the 100%-abscissa. In an area measurement, the height of this coextensive triangle corresponds to the reduced well depth $S_{vk}$, FIG. 1.

The reduced peak height $S_{pk}$ is the height of the triangle, coextensive with the tip surfaces of the Abbott curve, with base length Smr1. Smr1 results from the intersection point of the Abbott curve with a parallel to the X-axis which runs through the intersection point of the extension of the above-mentioned secant with the 0%-axis.

In an area measurement, the parameters $S_k$, $S_{pk}$ and $S_{vk}$ allow a separate consideration of the profile in respect of the core region, peak region and groove region or well region.

The well density of the texture $n_{dm}$ can also be used as a further parameter of the surface. The well density states the maximum number of closed empty volumes, i.e. of the depressions or wells as a function of the measuring height c per $mm^2$. In this respect, the measuring height c corresponds to the value c which is also shown in the Abbott curve. Thus, at 100%, the measuring height c corresponds to the highest elevation of the surface and at 0%, it corresponds to the lowest point of the surface profile.

The following applies:

$n_{cl}$ (c)=number of closed empty areas per unit area ($1/mm^2$) at a given measuring height c (%), and $n_{clm}$=MAX ($n_{cl}$ ($c_i$)), where $n_{clm}$ corresponds to the maximum number of closed empty areas per unit area ($1/mm^2$), where c, =0 to 100%.

Finally, the closed empty volume $V_{vcl}$ of the surface is also used to characterise the surface. It determines the receiving capacity of the surface, for example for lubricants. The closed empty volume is determined by determining the closed empty area $A_{vcl}$(c) as a function of the measuring height c. The closed empty volume $V_{vcl}$ is then obtained from:

$$V_{vcl} = \int_0^{100\%} A_{vcl}(c)dc$$

The surface can also be described using the skewness of the topography of the surface $S_{sk}$. This indicates whether the measured surface has a plateau-like structure with depressions or whether the surface is formed with elevations or peaks. According to DIN EN ISO 25178-2, the $S_{sk}$ is the quotient of the mean cube of the ordinate values and of the cube of the mean quadratic height $S_q$. The following applies:

$$S_{sk} = \frac{1}{S_q^3}\left(\frac{1}{A}\int\int_A z^3(x, y)dxdy\right),$$

where A is the restricted surface part of the measurement and z is the height of the measuring point. The following applies to $S_q$:

$$S_q = \sqrt{\frac{1}{A}\int\int_A z^2(x, y)dxdy}.$$

If $S_{sk}$ is less than zero, there is a plateau-like surface defined by depressions. If $S_{sk}$ is greater than zero, the surface is defined by peaks and has no or only a very small plateau-like surface portion.

According to a preferred embodiment, at least one surface of a strip or sheet has a reduced well depth $S_{vk}$ of 1.0 μm-6.0 μm, preferably 1.5 μm-4.0 μm, more preferably 2.2 μm-4 μm. With a reduced well depth of 1.0 μm-6.0 μm, a reduced well depth $S_{vk}$ reduced by at least factor 4 compared to conventionally roll-embossed surface structures can be provided on the strip or sheet according to the invention of an aluminium alloy. The values which are preferably chosen for the reduced well depth allow an improved forming behaviour, without influencing the subsequent surface characteristics, for example the surface impression, after lacquering.

According to a further embodiment of the strip according to the invention, the closed empty volume $V_{vcl}$ preferably amounts to at least 450 $mm^3/m^2$, preferably to at least 500 $mm^3/m^2$. As a practical upper limit, 1000 $mm^3/m^2$ or 800 $mm^3/m^2$ can be considered. However, values above 1000 $mm^3/m^2$ are also conceivable. The strip surface according to the present invention can thus provide significantly more lubricant for the forming process than the conventional surfaces used hitherto.

According to a further embodiment, the aluminium alloy strip according to the invention has a well density $n_{clm}$ of the surface increased by at least 25% compared to conventionally produced surface textures, for example EDT textures. The well density of the surface preferably amounts to more than 80 to 180 wells per $mm^2$, preferably 100 to 150 wells per $mm^2$.

A further embodiment of the aluminium alloy strip has a skewness of the topography of the surface $S_{sk}$ of 0 to −8, preferably −1 to −8. Consequently, this ensures that the surface has a plateau-like structure which is provided with depressions thereby providing lubricant pockets. This surface topography, in particular with a skewness of −1 to −8, is achieved, for example, by electrochemically graining a "mill finish"-roll surface, and has a preferred forming behaviour.

According to a further embodiment of the strip or sheet according to the invention, the strip or sheet is in an annealed state ("0"), a solution heat treated and quenched state ("T4") or the H19 or H48 state. Both states have a maximum formability and, together with the novel surface structure of the strip or sheet, allow an enhancement of the formability. While state "O" is provided by every material, hardenable materials, for example AA6xxx alloys, are solution heat-treated and then quenched. This state is denoted as T4. However, in general, both states are preferably intended for forming processes, since in this state, the sheet or strip allows maximum degrees of forming, depending on the respective material. Furthermore, in state T4, an increase in the strength is enabled by hardening. The alloys for can production are preferably in state H19 or H48 as consequently, the necessary strengths can be provided after forming and after further processing into the beverage can.

According to a further embodiment, the strip or sheet has a passivation layer which is applied after electrochemical graining. This passivation layer usually consists of chromate-free conversion materials which protect the surface of the aluminium strip or sheet against corrosion. Therefore, a specific passivation layer is the conversion layer. The passivation applied after electrochemical graining does not influence the provision of lubricant pockets for the forming process of the strip or sheet, so that also passivated strips and sheets can be provided with a surface optimised for forming operations.

As an alternative to passivation, the aluminium sheet or strip can be provided at least in some regions with a protective oil for protecting the aluminium strip or aluminium alloy sheet against corrosion.

According to a further embodiment, the strip or sheet has at least in some regions of the surface a forming aid, in particular a dry lubricant which can serve as a protective layer and as a lubricant in subsequent forming processes. As a result, it is possible to provide a particularly storable product which, at the same time, is also easy to handle due to the protective layer.

According to a second teaching of the present invention, the object stated above is achieved for a method for producing an aluminium alloy strip or sheet in that a hot-rolled and/or a cold-rolled strip or sheet consisting of an aluminium alloy is subjected to a unilateral or bilateral electrochemical graining process after rolling, wherein said electrochemical graining process introduces homogeneously distributed depressions as lubricant pockets into the strip or sheet consisting of an aluminium alloy. The accordingly produced aluminium alloy strips or sheets have specific surfaces. The rolled-in texture of the strip or sheet is retained except for the additionally introduced depressions, which have been introduced by electrochemical graining. The rolled texture forms, for example in the case of a "mill finish" surface, a plateau-like surface in which homogeneously distributed depressions are present as lubricant pockets. Thus, the aluminium alloy strip or sheet according to the invention differs significantly from conventionally produced aluminium alloy strips or sheets, the texture of which is not formed in a plateau-like manner as a result of the texture roll-embossing.

The strip or sheet is preferably subjected to a forming procedure, for example to deep-drawing. In practice, deep-drawing usually comprises deep-drawing and stretch-forming parts. In this respect, the aluminium alloy strip or sheet can be previously coated with a forming aid, for example with a lubricant or dry lubricant, so that an even better forming behaviour is achieved by the lubricant present in the lubricant pockets due to the optimised surface structure and the improved coating of lubricant.

According to a further embodiment of the aluminium alloy strip or sheet, the mean roughness $S_a$ of the surface of the strip or sheet is 0.5 μm to 2.0 μm, preferably 0.7 μm to 1.5 μm, more preferably 0.7 μm to 1.3 μm or preferably 0.8 μm to 1.2 μm. Sheets or strips for internal parts of a motor vehicle preferably have a mean roughness $S_a$ of 0.7 μm to 1.3 μm and external skin parts of a motor vehicle have a mean roughness $S_a$ of 0.8 μm to 1.2 μm. External and internal parts of a motor vehicle then obtain a very good surface impression.

Furthermore, the hot-rolled and/or cold-rolled strip or sheet preferably has a minimum thickness of 0.8 mm. Aluminium alloy strips or sheets having a thickness of at least 0.8 mm are often subjected to a forming process, for example to a deep-drawing process, in order to bring a planar sheet into a specific form required for the use, for example. In addition, preferred thicknesses in the automotive sector are also 1.0 to 1.5 mm, for example for attachment parts such as doors, bonnets and hatches, but also 2 mm to 3 mm or up to 4 mm for structural components, for example, such as parts of the frame construction or the chassis. Corresponding sheets are subjected to forming processes and are used in the automotive sector, for example in chassis applications or as structural components. The greater the thickness of the sheets, the higher the forming forces which are required. Thereby, the surface friction in the tool also increases during forming. As the thickness increases, so do the demands which are imposed on the forming properties of the sheets or strips. The surface finish thus plays a part in contributing to achieving maximum forming results. High forming requirements are demanded in particular for attachment parts having sheet thicknesses of 1.0 mm to 1.5 mm, because here, the option of individual shaping of the often visible sheets is very important.

However, strips or sheets having a smaller thickness, for example strips for the production of beverage cans having a thickness of less than 0.8 mm, for example 0.1 mm to 0.5 mm can benefit from the surface structure which is introduced according to the invention, because, for example, during production of beverage cans, the limits of the forming properties of the aluminium alloy strips and sheets are usually almost exhausted. It is assumed that the aluminium alloy strips produced with a forming-optimised surface according to the invention also allow further improvement in the forming of these thin sheets.

As already stated, in contrast to the known prior art, the surface structure of the aluminium strip is carried out by an electrochemical graining method using an electrolyte. The introduction of charge carriers and the current density can be used to adjust the surface structure and the portion of roughened surface without an additional rolling step.

The method is not only easy to handle, but can also be effectively scaled to large throughput quantities.

According to a first embodiment of the method according to the invention, electrochemical graining is used to preferably introduce into the surface of the strip or sheet depressions having a reduced well depth $S_{vk}$ of 1.0 μm-6.0 μm, preferably 1.5 μm-4.0 μm, more preferably 2.2 μm-4.0 μm. It has been found that strips with a corresponding surface topography achieve improved characteristics in the drawing test using a cross tool. The tribological characteristics of the aluminium sheet or strip can be improved thereby. With the restricted depression depths $S_{vk}$ of 1.5 μm to 4.0 μm or 2.2 μm to 4.0 μm, it is possible to achieve an improved forming behaviour, without influencing the subsequent surface characteristics, for example the surface impression after lacquering.

According to a further embodiment, prior to electrochemical graining, the strip or sheet is preferably subjected to a cleaning step in which the surface is cleaned and material is removed homogeneously by alkaline or acidic pickling and optionally using further degreasing agents. The material removal is substantially supposed to remove contaminants on the surface which have been introduced by rolling, so that a most suitable surface is available for the electrochemical graining process.

Electrochemical graining is preferably carried out using $HNO_3$ in a concentration of 2 to 20 g/l, preferably 2.5 to 15 g/l, and with an introduction of charge carriers of at least 200 C/dm$^2$, preferably at least 500 C/dm$^2$. The current densities can vary from at least 1 A/dm$^2$ to preferably up to 60 A/dm$^2$ or 100 A/dm$^2$. Stated here are the peak alternating current densities or the peak current densities of pulsed direct current. Using the mentioned parameters, it is possible to achieve a satisfactory surface covering of the grained regions, while observing economical processing times and electrolyte temperatures of less than 75° C., preferably within a range of between room temperature and 50° C. or 40° C. Hydrochloric acid can also be used as electrolyte as an alternative to nitric acid.

The method according to the invention can be further configured in that after electrochemical graining, the strip surface is passivated, preferably by applying a conversion layer and/or a forming aid. A forming aid is understood as meaning, for example, lubricants and dry lubricants which can optionally be meltable. The conversion layer and the forming aid can be formed as a protective layer and individually or simultaneously improve the corrosion resistance and thus the storability of the strip or sheet. The forming aid also improves the forming properties. In addition, as an alternative to the conversion layer, a protective oil can also be applied at least in some regions to protect the surface of the aluminium alloy strip or sheet against corrosion. The application of the conversion layer is preferably combined with the application of a preferably meltable forming aid, in particular a meltable dry lubricant, for example a so-called "hotmelt".

If at least some of the mentioned process steps are carried out in a common production line, it is possible to provide a particularly economical production of a corresponding strip surface or of a corresponding aluminium alloy strip or sheet. Correspondingly produced strips and sheets are at the same time storable and can be easily handled since they are protected against corrosion and mechanical damage.

Preferably, after annealing or after solution heat treating and quenching, the strip or sheet is grained electrochemically. This has the advantage that the heat treatment cannot adversely affect the surface characteristics of the sheet after the electrochemical graining process, and a strip or sheet which is optimised in respect of the forming requirements can be provided. Optionally, however, the surface texturing by electrochemical graining can also be carried out prior to the final annealing process, i.e. prior to annealing or prior to solution heat treating and quenching.

According to a further embodiment of the method according to the invention, the method steps are preferably carried out in a production line:

- unwinding the strip from a reel,
- cleaning and pickling the strip,
- electrochemically graining the strip and
- applying, at least in some regions, a forming aid and/or a conversion layer or alternatively a protective oil.

As a result of these production steps, it is possible to provide storable aluminium alloy strips and sheets in an economical manner. The characteristics of the surface of the aluminium alloy strips and sheets prepared for the forming processes remain substantially unchanged during storage. Lubricants, in particular dry lubricants, for example hotmelts, are used as forming aids. At room temperature (20-22° C.), these form a non-running, pasty, almost dry-to-touch thin film on the surface of the strip or sheet, based on mineral oil, synthetic oil and/or renewable raw materials. Compared to protective oils, hotmelts have improved lubrication properties, in particular during deep-drawing.

Finally, according to a third teaching, the stated object is achieved by a formed sheet of a motor vehicle, produced from a strip or sheet according to the invention, consisting of an aluminium alloy.

Formed sheets, in particular parts of a motor vehicle, to some extent require very high forming degrees, which can be provided by the strip or sheet according to the invention. The forming degrees are achieved by the specific surface structure of the sheets or strips which is also at least still partially maintained on the finished end product, the formed sheet. This depends on the specific forming process. Due to the improved forming properties, it is possible to achieve further weight reduction potentials for motor vehicles by the greater versatility of aluminium alloy sheets. In particular, the shaping demands imposed on the sheet, i.e. form requirements due to the design, can be satisfied more effectively with aluminium alloy sheets.

BRIEF DESCRIPTION OF THE DRAWINGS

The invention will be described below in more detail with reference to embodiments in conjunction with the drawings, in which.

DETAILED DESCRIPTION OF THE INVENTION

Figure 1:
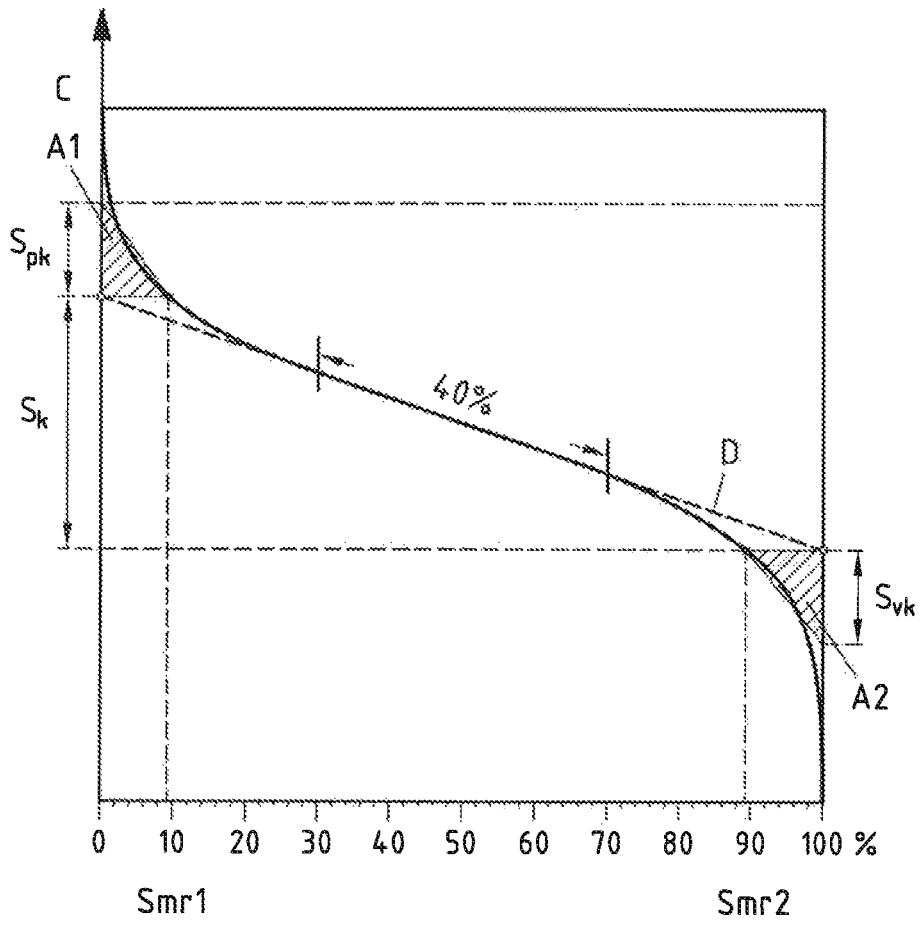
FIG. 1 schematically shows the determination of the parameters $S_k$, $S_{pk}$ and $S_{vk}$ using an Abbott curve.

FIG. 1 shows how the parameter values for the core roughness depth $S_k$, the reduced well depth $S_{vk}$ and the reduced peak height $S_p$k can be calculated from an Abbott curve. According to DIN-EN-ISO 25178, the determination is carried out for a standardized measurement area. Optical measuring methods, for example confocal microscopy, are usually used to calculate a height profile of a measurement area. By the height profile of the measurement area, it is possible to calculate the area portion of the profile which intersects an area parallel to the measurement area in height c or which runs above the area. Presenting the height c of the intersecting area as a function of the area portion of the intersecting area to the total area, the Abbott curve is obtained which shows the typical S-shaped course for rolled surfaces.

In order to determine the core roughness depth $S_k$, the reduced well depth $S_{vk}$ and the reduced peak height $S_{pk}$, respectively, a secant D with 40% length is displaced on the determined Abbott curve so that the amount of increase of the secant D is minimal. The core roughness depth $S_k$ of the surface results from the difference of the abscissa values of the intersection points of the secant D with the abscissa at 0% area portion and at 100% area portion. The reduced peak height $S_{pk}$ and the reduced well depth $S_{vk}$ correspond to the height of a triangle which is coextensive with the peak area A1 or the groove area A2 of the Abbott curve. The triangle of the peak area A1 has as base area the value Smr1 which results from the intersection point of a parallel to the X-axis with the Abbott curve, the parallel to the X-axis running through the intersection point of the secant D with the abscissa at 0% area portion. The triangle of the groove area or well area A2 has as base area the value 100%-Smr2, where Smr2 results from the intersection point of a parallel to the X-axis with the Abbott curve and the parallel to the X-axis runs through the intersection point of the secant D with the abscissa at 100% area portion.

These characteristic values can be used to characterise the measurement profile. It can be determined whether it is a plateau-like height profile with depressions, or, for example, whether the peaks predominate in the height profile of the measurement area. In the former case, the value for $S_{vk}$ increases, and in the latter case, the value for $S_{pk}$ increases.

As a further parameter of the surface, the well density of the texture $n_{clm}$ ican be calculated from the optical measurement of the surfaces via the maximum number of closed empty volumes $n_{clm}$, i.e. of the depressions or wells as a function of the measuring height c in percent per $mm^2$. This generates the number of closed empty areas per unit area ($1/mm^2$) at a given measuring height c (%). The maximum $n_{clm}$ is determined from $n_{cl}(c)$. The greater $n_{clm}$, the finer the surface structure.

Furthermore, the closed empty volume $V_{vcl}$ can also be calculated by the optical measurement by integrating the closed empty areas $A_{vcl}(c)$ via the measuring height c. The closed empty volume is also a characteristic surface feature of the strips and sheets according to the invention.

As already stated, the roughness of the surface is measured optically, as in this way, sampling can be carried out substantially faster compared to a tactile measurement. Optical detection is carried out, for example, by interferometry or confocal microscopy, as was done with the present measured data. According to EN ISO 25178-2, the size of the measuring areas is also established. The measured data were calculated via quadratic measuring areas of a side length of respectively 2 mm.

Figure 2:
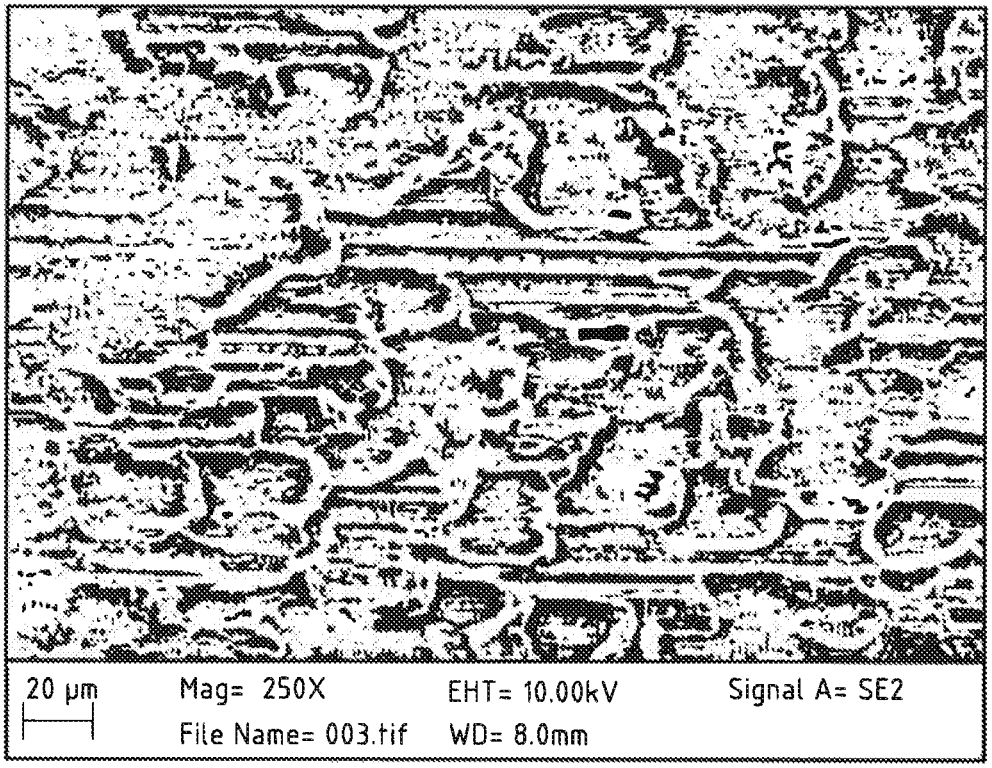
FIG. 2 shows a microscopic image of an embodiment not according to the invention.
Figure 3:
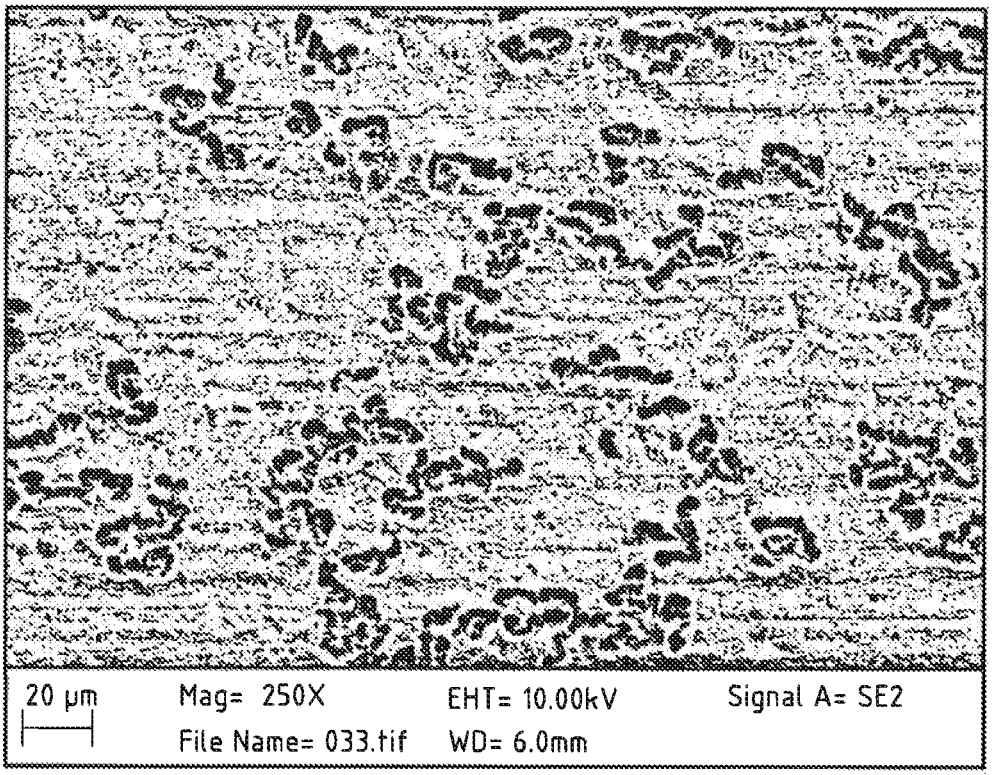
FIG. 3 shows a microscopically enhanced image of an embodiment of a strip surface according to the invention.

To illustrate the differences between the conventional strips roughened with EDT-structured rolls for example, and the strips structured according to the invention, FIG. 2 shows a 250-fold enlarged view of a conventional strip surface. On the other hand, FIG. 3 shows an embodiment of a strip surface according to the invention which was produced by an electrochemical graining method, also in 250-fold magnification. It can be clearly seen that, on the one hand, the structures in the electrochemical graining are finer and consist of depressions in a plateau-like surface. In contrast to the conventional roll-embossing shown in FIG. 2, in electrochemical graining according to the invention no peaks are introduced into the material, but the rolled surface, here a mill finish surface, is only altered or modulated by the introduction of depressions. It is presently assumed that the depressions produced by electrochemical graining can provide more lubricant for the forming process due to the greater closed empty volumes, and therefore improved forming properties are achieved. It has also been found that the greater well depth $S_{vk}$ can obviously provide lubricant during forming even with a great surface stress and thus improves the forming behaviour.

Figure 4:
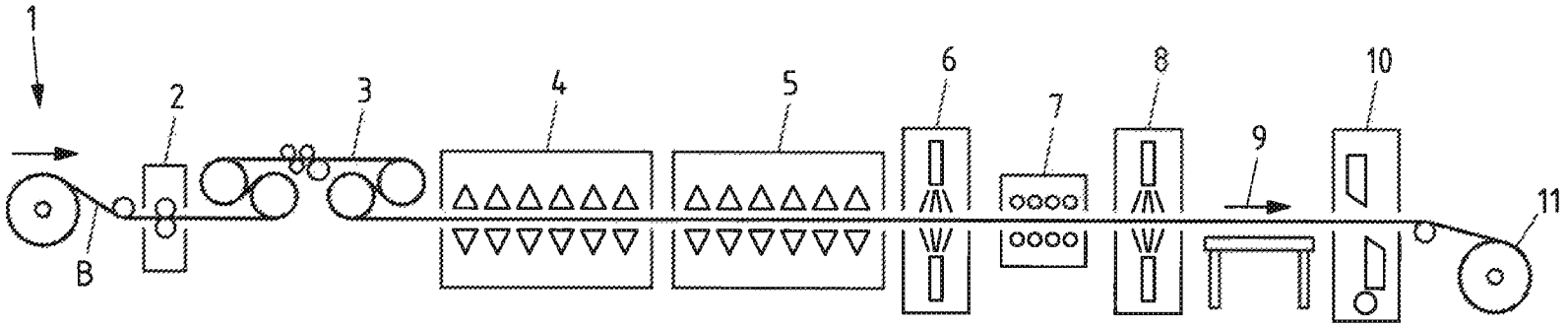
FIG. 4 schematically shows an embodiment of a production line for implementation of the method according to the invention.

FIG. 4 shows a first embodiment of a method using a schematic of a production line for producing a strip B according to the invention. In the embodiment shown, the strip B which preferably at least partially consists of an aluminium alloy of type AA7xxx, type AA6xxx or type AA5xxx or type AA3xxx, in particular AA7020, AA7021, AA7108, AA6111, AA6060, AA6014, AA6016, AA6106, AA6005C, AA6451, AA5454, AA5754, AA5182, AA5251, AA3104, AA3103 or AlMg6 is unwound from a reel 1. The thickness of the strip is preferably at least 0.8 mm but at most 3 mm and preferably between 1.0 mm and 1.5 mm, for example for use in the automotive sector. In principle, the thickness can also be 0.1 mm to 0.5 mm, for example in the case of strips for beverage can production. The improved forming behaviour during beverage can production requiring maximum forming degrees is apparent in the case of these thin strips as well.

According to the present embodiment, the strip unwound from the reel 1 is preferably in the annealed state "O", if it is an aluminium alloy of type AASxxx, AlMg6 or AA3xxx, or in the solution heat treated and quenched state "T4" state, in the case of an aluminium alloy of type AA6xxx or AA7xxx. The strip is thus already in a particularly effectively formable state. However, it is also conceivable to carry out the heat treatment after the surface processing or after the introduction of the depressions and, in so doing, to process the surface of rolled strips. In addition, strips and sheets of type AASxxx or AA3xxx for beverage can production are also in state H19 or lacquered in state H48 before they are formed.

According to the embodiment, the unwound aluminium alloy strip B is delivered to an optional trimming procedure to trim the side edges 2. Thereafter, the strip also optionally passes through a straightening device to remove deformations from the strip. In the device 4, the strip is subjected to a cleaning and a pickling step. As etchant, it is possible to use mineral acids, but also bases, for example based on caustic soda. This can improve the response of the strip to electrochemical graining. The pickling step 4 is also optional. After rinsing, the aluminium strip undergoes an electrochemical graining process in step 5, in which depressions are introduced into the surface. During electrochemical graining, depressions are introduced into the strip and aluminium is dissolved out in the corresponding spots as a result of the reaction of the electrolyte with the aluminium alloy strip. Electrochemical graining is preferably adjusted such that a well depth $S_{vk}$ of 1.0 μm-6.0 μm, preferably 1.5 μm-4.0 μm, more preferably 2.2 μm-4.0 μm is achieved. It has been found that with these characteristic values, the forming behaviour of the aluminium alloy strip is very good in a subsequent forming process.

Electrochemical graining is preferably carried out using $HNO_3$ (nitric acid) in a concentration of 2.5-20 g/l, preferably with 2.5 to 15 g/l with alternating current of a frequency of 50 Hz. The introduction of charge carriers is preferably at least 200 $C/dm^2$, preferably at least 500 $C/dm^2$, to achieve a satisfactory surface covering with electrochemically introduced depressions. For this purpose, at least 1 $A/dm^2$, preferably up to 100 $A/dm^2$ and more are used as peak current densities. The choice of current densities and the concentration of the electrolyte depend on the production rate and can be adjusted accordingly. In particular, the reactivity and thus the production rate can also be influenced by the temperature of the electrolyte. The electrolyte can preferably have a maximum temperature of 75° C. When nitric acid is used as electrolyte, a preferred working range is between room temperature and approximately 40° C., at most 50° C. In addition to nitric acid, hydrochloric acid is also suitable as electrolyte.

The surface of strip B is preferably subjected to electrochemical graining on both sides in step 6. However, it is also conceivable for a corresponding surface structure to be introduced only on one side. Thereafter in working step 6, according to the embodiment shown in FIG. 5, either a protective oil can be applied or the surface of the aluminium alloy strip can be passivated, for example by applying a conversion layer. These processing steps are also optional.

A drying procedure is preferably carried out in step 7, before an optional layer having a forming aid is applied to the strip, preferably on both sides thereof, in step 8 according to the embodiment shown. The forming aid is preferably a lubricant, in particular a meltable dry lubricant, for example a hotmelt. A meltable dry lubricant as a protective layer and lubricant can simplify the handling of the aluminium alloy strips or sheets according to the invention and, at the same time, further improve the forming properties. Wool wax, for example, can also be used as a dry lubricant from renewable raw materials.

As an alternative to winding up the strip B with the reel 11, the belt shears 10 can cut the strip into sheets. In step 9, the strip is examined visually for defects so that surface defects can be detected early.

As already stated, the embodiment from FIG. 4 shows several optional working steps which are carried out inline directly one after another in the same production line. Therefore, the embodiment from FIG. 4 is a particularly economical variant of the method according to the invention. However, it is also conceivable to merely combine the unreeling of a strip according to step 1 and the electrochemical graining according to step 5 with an operation for winding-up or cutting into sheet metal blanks. In principle, an electrochemical graining of sheet metal blanks is also conceivable.

Figure 5:
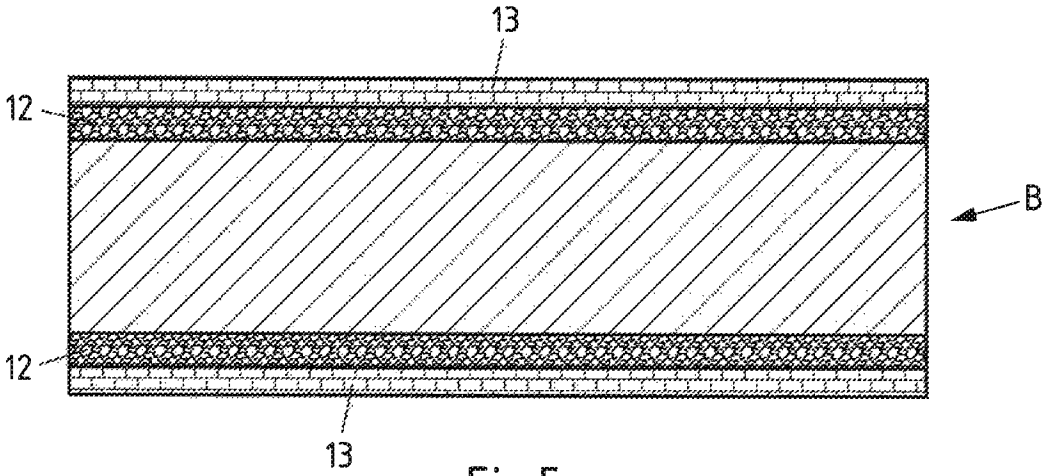
FIG. 5 is a schematic sectional view of an embodiment of a strip or sheet according to the invention.

FIG. 5 is a schematic sectional view of an embodiment of a strip B according to the invention which has depressions 12 introduced into both sides of the surface and also an applied layer of a meltable dry lubricant 13. A corresponding strip B has maximum forming properties and furthermore can be easily stored as the surface is protected. Corresponding strips B, also with a unilaterally grained surface, can also be used as external skin parts of a motor vehicle since the surface is maximally protected against the forming process and assists the forming procedure to a significant extent. Sheets produced from a strip B have a very good handling ability in the forming process due to the surface protection.

Figure 6A:
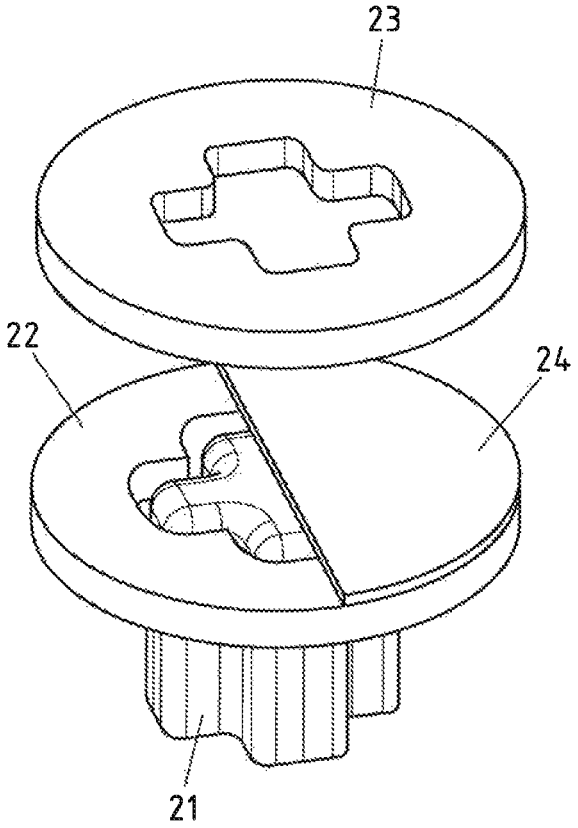
FIG. 6*a*), 6*b*) are schematic, perspective sectional views of the test arrangement of the drawing test using a cross tool for determining the forming behaviour.
Figure 6B:
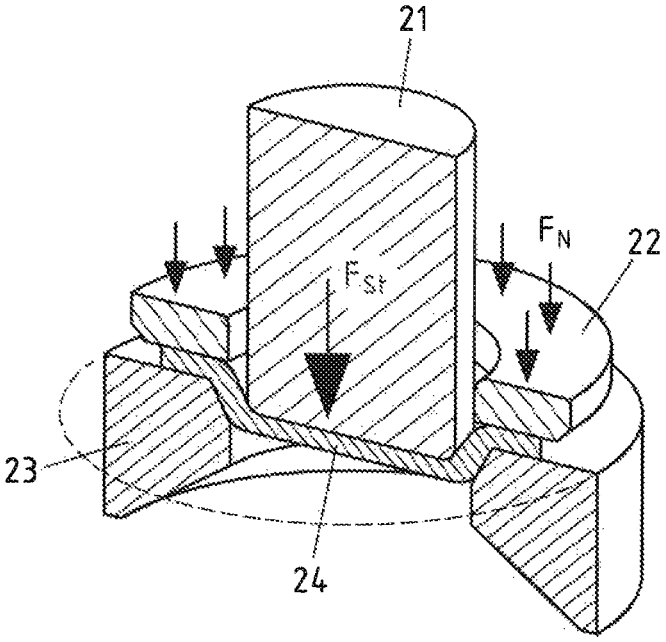
Figure 7:
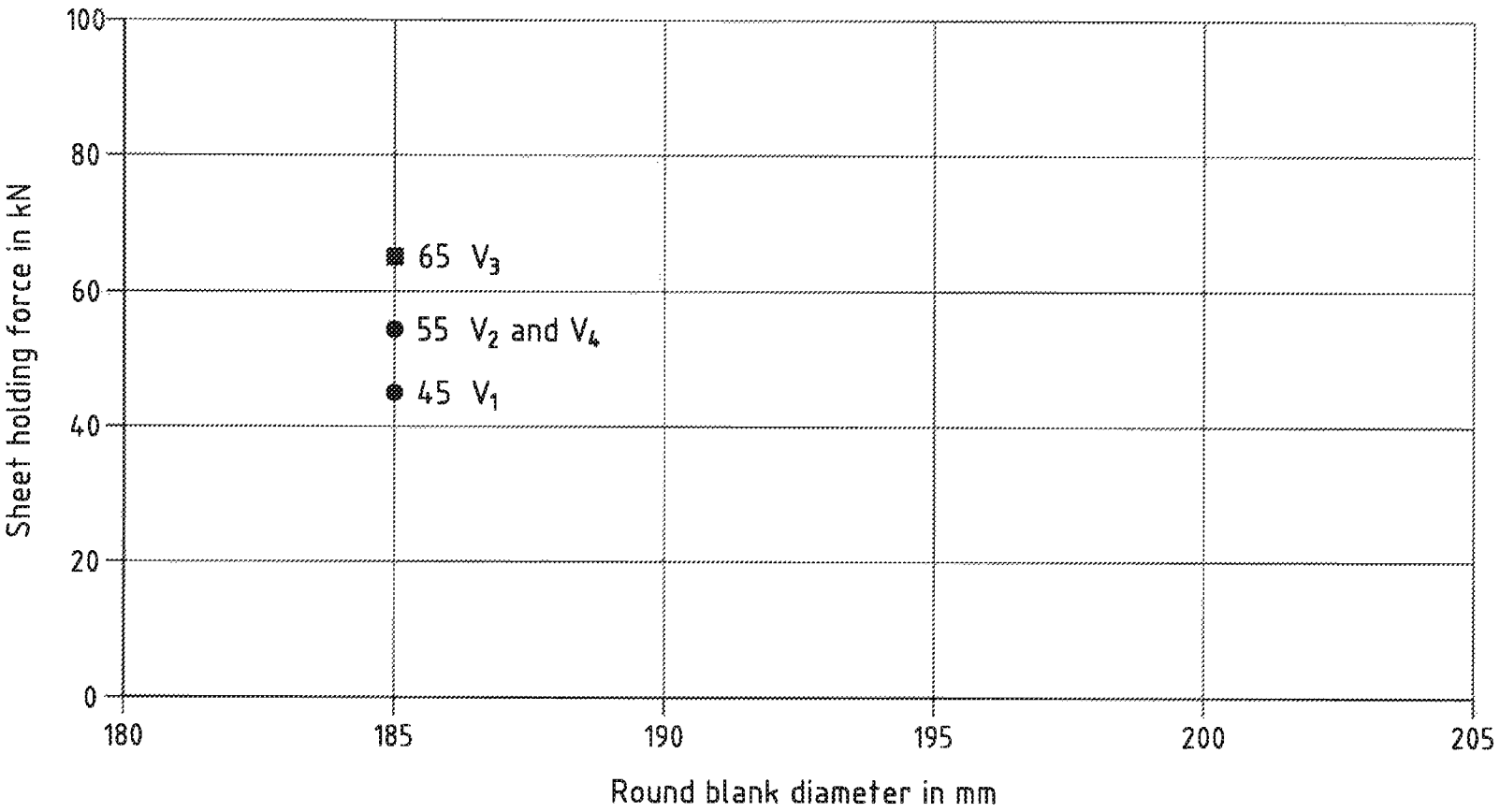
FIG. 7 is a diagram showing the maximum sheet holding force in kN during the drawing test using a cross tool as a function of the round blank diameter of the sheet.

To test the forming properties of the sheets which have electrochemically grained surfaces in the forming process, drawing tests using a cross tool were carried out. FIG. 6*a* is a perspective sectional view of the configuration of the cross tool. The cross tool comprises a punch 21, a hold-down device 22 and a die 23. The sheet 24 to be tested was roughened either by a conventional method, for example only by EDT rolling, or only by the electrochemical graining according to the invention, but also in addition to EDT rolling.

During the drawing test in the cross tool, the sheet 24 formed as a round blank is deep-drawn by the punching force FsT, the hold-down device 22 and the die 23 being pressed onto the round blank with force FN. The cross-shaped punch 21 respectively has a width of 126 mm along the axes of the cross, while the die has an aperture width of 129.4 mm. The round sheet blank 24 was produced from different aluminium alloys and had different diameters. The round sheet blanks were also provided with different surface topographies to examine the forming behaviour.

The surface topographies of the comparative examples were produced by conventional methods by roll-embossing using an EDT-textured roll or by rolling using a roll with a "mill finish" surface. The surfaces imprinted by EDT rolls as well as the "mill finish"-prepared surfaces were roughened electrochemically by the method according to the invention in order to show the technical effect of the roughening procedure.

In the tests, the punch 21 was lowered at a rate of 1.5 mm/s in the direction of the sheet and the sheet 4 was deep-drawn according to the form of the punch. The punch force and the punch path were measured up until the sample cracked and were recorded. The greater the diameter of the round blank which could be formed without cracking, the better the forming properties of the sheet.

Finally, sheets having different surface topographies were produced from an aluminium alloy of type AA5xxx and also of type AA6xxx and were measured in respect of their surface parameters using a confocal microscope. The strips of aluminium alloy of type AA5xxx were in state "O" and the strips of aluminium alloy of type AA6xxx were in state "T4". An aluminium alloy of type AA 5182 was used as AA5xxx. The aluminium alloy of AA6xxx alloy corresponded to an aluminium alloy of type AA6005C. Tests V1 to V4 were carried out using an identical aluminium alloy of type AA6005C and tests V5 to V8 were carried out using an identical aluminium alloy of type AA5182 to rule out influences of different compositions within the types of alloys.

The sheets roughened by an EDT-textured roll as well as the sheets provided with a "mill finish" surface were additionally subjected to electrochemical graining and were designated as tests V3 and V4. During electrochemical graining, charge carriers of 500 C/dm$^2$ were introduced at an $HNO_3$ concentration of 2.5 g/l to 15 g/l, so that sheets having homogeneously distributed depressions were produced for tests V3 and V4. The well depth $S_{vk}$ of the surface of the electrochemically grained sheets was between 1.0 μm and 6.0 μm. All the surfaces were coated with a lubricant of the AVILUB Metapress type. The layer thickness was 1 g/m$^2$. The following Table shows the four different surface variants and the associated sheet thicknesses:

TABLE 1

| No. | | Alloy | Surface | EC graining | Strip thickness |
|---|---|---|---|---|---|
| V1 | Comparison | 6005C | Mill finish | No | 1.15 mm |
| V2 | Comparison | 6005C | EDT | No | 1.10 mm |
| V3 | Invention | 6005C | Mill finish | Yes | 1.15 mm |
| V4 | Invention | 6005C | EDT | Yes | 1.10 mm |
| V5 | Comparison | 5182 | Mill finish | No | 1.15 mm |
| V6 | Comparison | 5182 | EDT | No | 1.10 mm |
| V7 | Invention | 5182 | Mill finish | Yes | 1.15 mm |
| V8 | Invention | 5182 | EDT | Yes | 1.10 mm |

The samples were then tested in the cross tool in respect of their forming behaviour. All tests were carried out in state T4, i.e. in the solution heat-treated and quenched state. In the drawing test, using a cross tool, the sheet holding force at which the sheet cracks during the drawing procedure is determined. It was found that with the round sheet blanks which have a "mill finish" surface according to V1, holding forces of 45 kN could be achieved with a round blank diameter of 185 mm. The roll-embossed round sheet blanks achieved 55 kN holding forces with the same round blank diameter. It was found that an additional roughening of the EDT-roll-embossed surface according to test V4 produced identical results. The combination of "mill finish" surface and subsequent electrochemical graining according to V3 showed cracks only at sheet holding forces of more than 65 kN. This is a significant improvement in the forming behaviour compared to the EDT variants V2 and V4.

The four test variants V1 to V4 were also subjected to further drawing tests using a cross tool, in which a drawing film was additionally used on both sides. A conventional PTFE deep-drawing film of a thickness of 45 μm was used as the drawing film. In a third variant, the sheets were coated before the drawing test with a very large amount of lubricant (8 g/m$^2$) and, using a drawing film, the drawing tests were carried out in the cross tool. As a result, the effect of the different surfaces should be suppressed.

Figure 8:
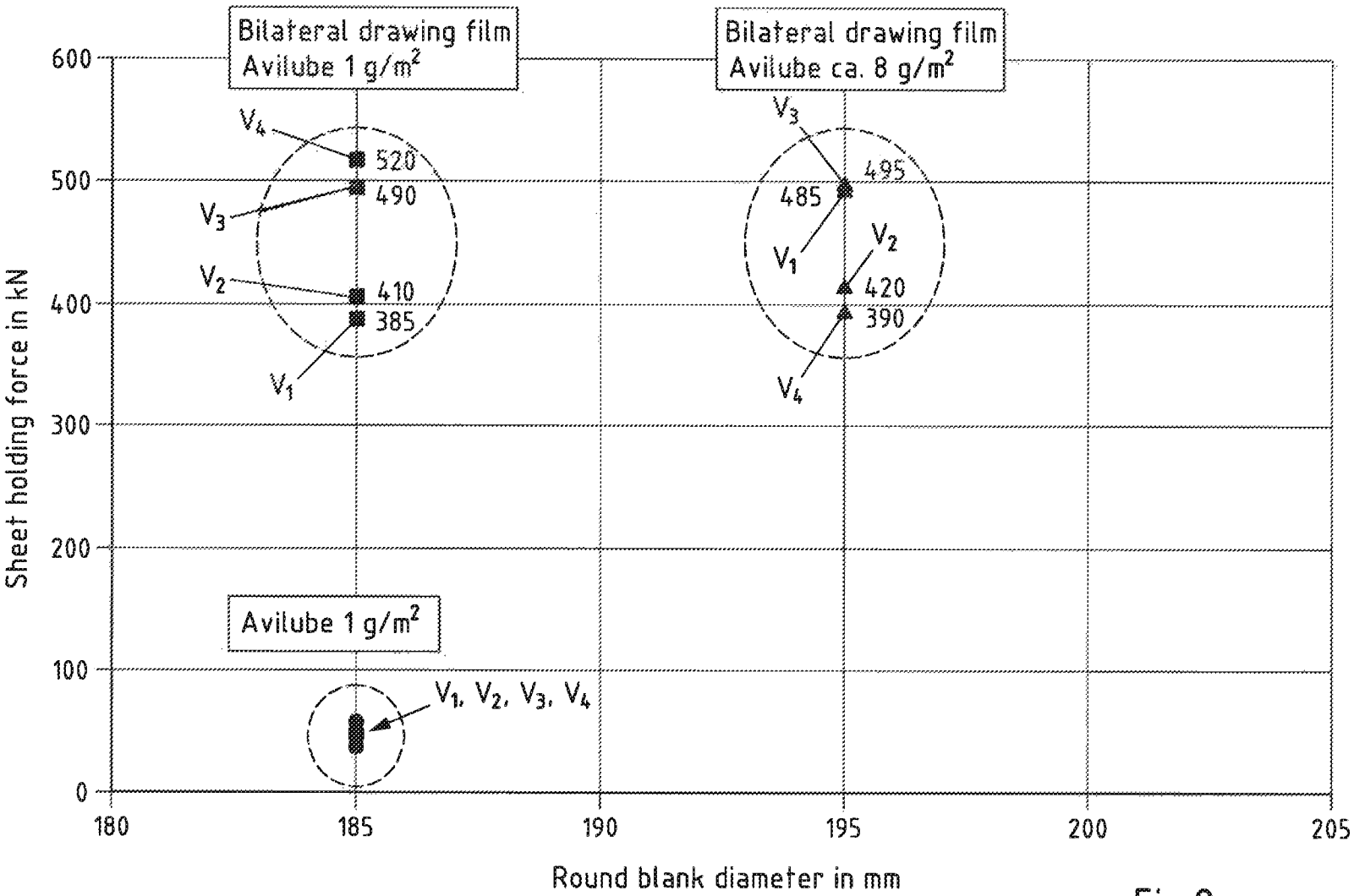
FIG. 8 shows the maximum sheet holding force for different round blank diameters with normal and very high use of lubricant.

FIG. 8 shows the test results. It can be seen that using a drawing film in the case of the surfaces of sheets V3 and V4 also roughened by electrochemical graining, the sheet holding forces could be significantly increased compared to the non-roughened surfaces of sheets V1 and V3. Here, it is found that variant V4 with 520 kN and a round blank diameter of 185 mm achieved the highest values, followed by variant V3 with 490 kN. Significantly lower values were achieved with 410 kN for variant V2 and 385 kN for variant V1. Without a drawing film, the sheet holding forces are almost identical for all four test variants.

In the tests with a 195 mm round blank diameter, with a bilateral drawing film using a large amount of lubricant coating of 8 g/m$^2$, it was found, as expected, that the sheets according to V1 and V3, provided with a greater wall thickness, achieve higher values than the roll-embossed sheets of tests V2 and V4 provided with a smaller wall thickness. As expected, while disregarding the effects of the different surface topographies of tests V1 to V4 due to the use of a high proportion of lubricant (8 g/m$^2$), the forming properties of the sheets in the drawing test using a cross tool depend only on the wall thickness of the sheets.

Figure 9:
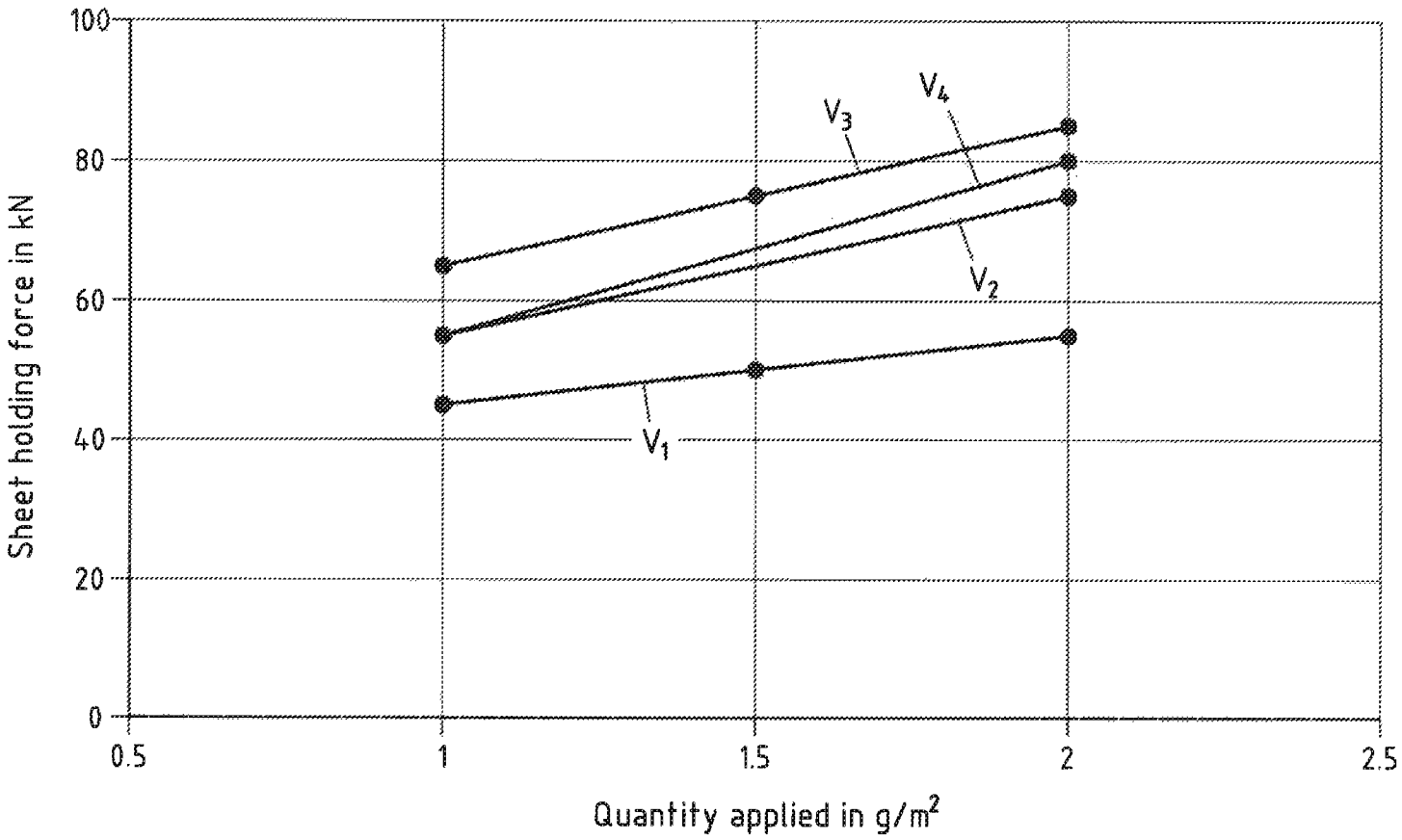
FIG. 9 is a diagram showing the maximum sheet holding force in kN as a function of the quantity applied in g/m$^2$ of a lubricant.

In FIG. 9, it was examined how the addition of lubricant improves the formability of the different surface topographies. It was found that the electrochemically grained variants showed a significantly stronger effect upon the addition of lubricants, so that it can be assumed that a greater quantity of lubricants can be applied and a greater lubricant effect can be achieved. In the cross tool test, the sheet holding force in the case of the electrochemically grained "mill finish" surface according to V3 could be increased to approximately 85 kN. The electrochemically grained EDT-textured surface according to V4 allowed 80 kN and the conventional EDT-textured surface according to V2 allowed 70 kN. In contrast, the conventional "mill finish" surface according to V1 achieved a maximum of only approximately 55 kN in this test.

Finally, sheets having the different topographies were produced from an aluminium alloy of type AASxxx as well as of type AA6xxx, and they were measured in respect of their surface parameters using a confocal microscope. The strips of aluminium alloy of type AASxxx were in state "O" and the strips of aluminium alloy of type AA6xxx were in state "T4". As AASxxx, an aluminium alloy of type AA 5182 was used. The aluminium alloy of the AA6xxx alloy corresponded to an aluminium alloy of type AA6005C.

Tests V2, V6 were textured conventionally using EDT rolls. Tests V1 and V5 had conventional "mill finish" surfaces. As can be seen from Table 2, the EDT-textured surfaces were subjected to an electrochemical graining process and were evaluated as tests V4 and V8. The same was carried out for the sheets with "mill finish" surfaces of both aluminium alloys. The electrochemically grained sheets were evaluated as tests V3 and V7. During electrochemical graining, an $HNO_3$ concentration of 4 g/l was used with a charge carrier introduction of 500 C/dm$^2$ in tests V3 and V4, and an $HNO_3$ concentration of 5 g/l with a charge carrier introduction of 900 C/dm$^2$ in tests V7 and V8. The electrolyte temperature was between 30° C. and 40° C. for all the variants.

In the visual measurement of the surfaces of the test sheets, it is noted, as expected, that sheets V2, V6 produced conventionally by EDT-textured rolls have significantly higher values in respect of the arithmetic mean roughness value $S_a$ and the reduced peak height $S_pk$ than the strips of tests V1 and V5 which have "mill finish" surfaces. The electrochemically grained embodiments V3, V4, V7 and V8, however, showed a mean roughness $S_a$ approximately on the level of the EDT surface texture of tests V2 and V6. The measured values are recorded in Table 2.

However, in contrast to the conventional texture, in electrochemical graining, the value for the reduced well depth $S_{vk}$ increases by more than factor 4, here at least by factor 5. This clearly indicates the differences in the textures.

The closed empty volume $V_{vcl}$, which represents the volume for the provision of lubricant in lubricant pockets, is greater for the strips textured conventionally by EDT rolling with 362 or 477 mm$^3$/m$^2$ compared to 151 mm$^3$/m$^2$ or 87 mm$^3$/m$^2$ of the "mill finish" variants V1 and V5.

However, the electrochemically grained embodiments V3, V4 as well as V7 and V8 according to the invention exhibit a closed empty volume $V_{vcl}$ of a least 500 mm$^3$/m$^2$. In the case of the strips according to the invention which have passed through an electrochemical graining step, the closed empty volume which is important for receiving lubricant can be increased by significantly more than 10%.

The well density of the structure with values of the variants V3, V4, V7 and V8 according to the invention of more than 80 per mm$^2$, preferably between 100 per mm$^2$ and 150 per mm$^2$, is greater by significantly more than 25% than in the case of conventionally EDT-textured strip surfaces of comparative tests V2 and V6.

The different topography of the embodiments according to the invention, which is characterised using the different values of the reduced well depth $S_{vk}$, the closed empty volume $V_{vcl}$ and the well density of the surface, is responsible for the improvement of the forming behaviour.

As a result, also a formed sheet, for example a door inner sheet or an external skin part of a motor vehicle, can thereby be provided which passes through high forming degrees until it is produced to the final form. With the method according to the invention and with the strip or sheet according to the invention, it is thus possible to provide an even broader field of application for aluminium alloys in the motor vehicle sector since the greater forming degrees allow further possibilities of use.

TABLE 2

| No. | | Alloy | $S_a$ µm | $S_{pk}$ µm | $S_k$ µm | $S_{vk}$ µm | Ssk | $N_{clm}$ 1/mm$^2$ | $V_{vcl}$ mm$^3$/m$^2$ |
|---|---|---|---|---|---|---|---|---|---|
| V1 | Comp. | 6005C | 0.38 | 1.21 | 0.98 | 0.57 | 2.72 | 75 | 151 |
| V2 | Comp. | 6005C | 0.83 | 1.56 | 2.79 | 0.40 | 0.79 | 66 | 362 |
| V3 | Invent. | 6005C | 0.93 | 0.47 | 1.33 | 3.34 | −1.32 | 123 | 555 |
| V4 | Invent. | 6005C | 1.13 | 1.50 | 3.21 | 2.08 | −0.18 | 94 | 566 |
| V5 | Comp. | 5182 | 0.37 | 0.51 | 1.21 | 0.37 | 0.32 | 56 | 87 |
| V6 | Comp. | 5182 | 1.13 | 2.66 | 2.54 | 0.34 | 1.35 | 67 | 477 |
| V7 | Invent. | 5182 | 0.93 | 0.55 | 1.84 | 3.13 | −2.15 | 135 | 605 |
| V8 | Invent. | 5182 | 1.19 | 2.42 | 2.87 | 2.03 | 0.56 | 83 | 542 |
| V13 (litho sheet after EC graining) | Comp. | AA1xxx | 0.3-0.6 | 0.2-0.55 | 0.9-1.5 | 0.44-1.1 | −0.85-0.32 | 200-240 | <360 |

Since electrochemical graining is also used in the production of printing plate carriers, a plurality of EC-grained litho sheets of alloy A1xxx were measured and the measured results were summarised as test V13. Although litho sheets are roughened electrochemically, the roughening procedure serves a different purpose. Furthermore, litho strips and sheets are not delivered to a forming procedure, but after electrochemical roughening, they are coated with a photosensitive layer. The roughening is to allow the most uniform printing result possible. Thus, litho sheets and strips are not prepared for forming within the sense of the present invention.

Therefore, the surfaces optimised according to the invention in respect of forming exhibit clear differences in topography compared to litho sheets, as demonstrated by the summarised measuring results of different measured litho sheets, shown in comparative example V13. Litho sheets usually not only have significantly lower mean roughness values $S_{vk}$, but also have a significantly less reduced well depth $S_{vk}$. The mean well density $n_{clm}$, however, is slightly above the electrochemically grained, forming-optimised surfaces of sheets V4, V3, V7 and V8 according to the invention.

In addition, electrochemically grained surfaces of an embodiment according to the invention were examined during differently strong forming procedures in the cross tool compared to surfaces of conventional sheets of an alloy of type AA6xxx textured by EDT rolling. It was found that the surfaces differ significantly in regions of slightly formed areas, as is also shown in FIGS. 2 and 3.

However, after the forming process, the surfaces exhibited almost identical formations, for example in the hold-down region and in the die radius of the cross tool, i.e. in strongly formed regions. In spite of providing an improved forming behaviour, it is therefore expected that the different starting topography will not have any effects on the surface impression. Therefore, aluminium alloy strips and sheets according to the invention are very well suited for the provision of external skin parts of a body of a motor vehicle, for example.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. Strip or sheet consisting of an aluminium alloy having a unilateral or bilateral surface structure which is provided at least in some regions and is prepared for a forming process, wherein the strip or sheet has on one side or on both sides a surface with depressions as lubricant pockets which are produced using an electrochemical graining method, the at least one surface of a strip or sheet having a reduced depression depth $S_{vk}$ of 1.0 µm to 6.0 µm and a closed empty volume $V_{vcl}$ amounts to at least 450 mm$^3$/m$^2$, wherein a depression density $N_{clm}$ amounts to 80 to 180 depressions/mm$^2$.

2. Strip or sheet according to claim 1, wherein the strip or sheet at least partially consists of an aluminium alloy of a type AA7xxx, AA6xxx, AA5xxx or AA3xxx.

3. Strip or sheet according to claim 1, wherein at least one surface of the strip or sheet has a reduced depression depth $S_{vk}$ of 1.5 µm to 4.0 µm.

4. Strip or sheet according to claim 1, wherein the sheet or strip is in an annealed state ("O"), a solution-annealed and quenched state ("T4") or a 3/4 hard state ("H19") or 4/4 hard lacquered and burned in state ("H48").

5. Strip or sheet according to claim 1, wherein the strip or sheet has a passivation layer which is applied after electrochemical graining.

6. Strip or sheet according to claim 1, wherein a lubricant is provided at least in some regions on the surface of the strip or sheet.

7. Strip or sheet according to claim 1, wherein a mean roughness of the surface $S_a$ is 0.7 μm to 1.5 μm.

8. Method for producing a strip or sheet according to claim 1 having a unilateral or bilateral surface structure, prepared for a forming process characterised in that a hot-rolled and/or a cold-rolled strip or sheet is subjected to an electrochemical graining process after rolling, wherein said electrochemical graining process introduces homogeneously distributed depressions as lubricant pockets at least into some regions of the strip or sheet, depressions being introduced into the surface of the strip or sheet by electromechanical graining having the reduced depression depth $S_{vk}$ of 1.0 μm to 6.0 μm and a closed empty volume $V_{vcl}$ amounts to at least 450 $mm^3/m^2$, wherein a depression density amounts to 80 to 180 depressions/$mm^2$.

9. Method for producing a strip according to claim 8, wherein depressions having the reduced depression depth $S_{vk}$ of 1.5 μm to 4.0 μm are introduced into the surface of the strip or sheet by electrochemical graining.

10. Method for producing a strip according to claim 8, wherein prior to electrochemical graining, the strip is subjected to a cleaning step in which the surface is cleaned and material is removed homogeneously by alkaline or acidic pickling.

11. Method for producing a strip according to claim 8, wherein electrochemical graining is carried out using $HNO_3$ in a concentration of 2.5 to 20 g/l with an introduction of charge carriers of at least 200 C/$dm^2$.

12. Method for producing a strip according to claim 8, wherein after electrochemical graining, the surface is passivated, preferably by applying a conversion layer, and/or a protective layer having a meltable forming aid is applied to the surface of the strip.

13. Method for producing a strip according to claim 8, wherein a strip is grained electrochemically after an annealing procedure (state "O"), after a solution heat treating and quenching procedure (state "T4"), or rolled in state H19.

14. Method for producing a strip according to claim 8, wherein the method steps are carried out inline in a production line:

unwinding the strip from a reel,
cleaning and pickling the strip,
electrochemically graining the strip and
applying, at least in some regions, a forming aid and/or a conversion layer or alternatively a protective oil.

15. Method for producing a strip according to claim 14, wherein after applying the conversion layer, a protective layer having a meltable forming aid is subsequently applied.

16. Use of the sheet according to claim 1 of a formed sheet for a motor vehicle.

17. Strip or sheet according to claim 1, wherein the strip or sheet at least partially consists of an aluminium alloy of type AA7020, AA7021, AA7108, AA6111, AA6060, AA6014, AA6016, AA6005C, AA6451, AA5454, AA5754, AA5182, AA5251, AlMg6, AA3104 and AA3103.

18. Strip or sheet according to claim 1, wherein at least one surface of the strip or sheet has a reduced well depth $S_{vk}$ of 2.2 μm to 4.0 μm.

19. Strip or sheet according to claim 1, wherein a mean roughness of the surface $S_a$ is 0.7 μm to 1.3 μm.

20. Strip or sheet according to claim 1, wherein a mean roughness of the surface $S_a$ is 0.8 μm to 1.2 μm.

* * * * *